US008933289B2

(12) United States Patent
Crichlow

(10) Patent No.: US 8,933,289 B2
(45) Date of Patent: Jan. 13, 2015

(54) METHOD FOR TEMPORARY OR PERMANENT DISPOSAL OF NUCLEAR WASTE

(76) Inventor: Henry Crichlow, Norman, OK (US)

( * ) Notice: Subject to any disclaimer, the term of this patent is extended or adjusted under 35 U.S.C. 154(b) by 1147 days.

(21) Appl. No.: 12/660,330

(22) Filed: Feb. 25, 2010

(65) Prior Publication Data

US 2010/0234663 A1 Sep. 16, 2010

Related U.S. Application Data

(63) Continuation of application No. 61/209,801, filed on Mar. 10, 2009.

(51) Int. Cl.
*G21F 9/24* (2006.01)

(52) U.S. Cl.
USPC ..... 588/17; 588/250

(58) Field of Classification Search
USPC ..... 588/16, 17, 20, 250, 900
See application file for complete search history.

(56) References Cited

U.S. PATENT DOCUMENTS 5,314,264 A * 5/1994 Danko et al. ..... 405/129.35
5,338,493 A * 8/1994 Welch ..... 588/16

* cited by examiner

*Primary Examiner* — Edward Johnson

(57) ABSTRACT

A method of disposing nuclear waste in underground rock formations is presented. The method includes the steps of selecting a land area having a rock formation positioned there-below of a depth able to prevent radioactive material placed therein from reaching the surface and drilling a vertical wellbore from the surface, to a depth ranging between 5,000 feet and 25,000 feet, into the underground rock formation or repository. A plurality of horizontal laterals or horizontal wellbores, ranging in length from 500 feet to 40,000 feet, are drilled from the vertical wellbore into the underground rock formation or repository. Nuclear waste to be stored within these laterals is encapsulated in a special waste canister and these nuclear waste canisters are positioned within the horizontal laterals wherein they are sealed to prevent loss and leakage. Means are also provided by which these canisters are adapted to allow retrievability of the canisters from the wellbore at a later date and to return the waste to the surface for use after retrieval.

11 Claims, 12 Drawing Sheets

METHOD FOR TEMPORARY OR PERMANENT DISPOSAL OF NUCLEAR WASTE

FIELD OF THE INVENTION

The present invention relates generally to a system and method of disposing of nuclear waste. More particularly, the invention relates to disposing of nuclear waste temporarily or permanently in underground rock formations using multilateral boreholes.

BACKGROUND

Numerous methods for disposing of nuclear waste are provided in the art. For example, an existing disposal method for nuclear waste is to bury the waste in shallow vaults also known as deep vertical wells. This method places the waste in vertical silos drilled into a mountain by a tunnel boring machine. The storage chambers are to be drilled approximately 1,000 feet into the mountain and can cost billions of dollars.

Another method proposed for disposing of nuclear waste is burial of the waste in suitable canisters in mud in the bottom of the ocean. This method is dangerous as the canisters may rupture and pollute the ocean, killing life found in the surrounding area.

A further proposal for disposing of nuclear waste is to place the waste into specially designed modules and launch the modules into space using the space shuttle. The modules will then be propelled into the sun for final incineration. This system would cost many billions of dollars and thus is not very practical.

Another method proposed is to bury the nuclear waste in suitable canisters and placing such canisters within salt caverns below the surface of earth. This method is not suitable as the salt caverns are located at quite shallow depths and in case there is a leakage, the water table may get contaminated.

It has also been proposed to bury the waste in near surface trenches or wells as used in landfills. This approach is not viable due to the great danger associated with disposing of the waste so close to the surface where leakage of the waste may do great harm to all life in the surrounding area.

It has further been proposed to bury the waste in deep vertical wells which will be sealed with cement or mud.

Burying the waste in the polar ice caps whereby the great masses of ice could enclose and isolate the radioactive material has also been proposed.

U.S. Pat. Nos. 5,850,614 and 6,238,138 teach an application of horizontal wellbores to serve as repositories of nuclear waste in deep underground reservoirs. U.S. Pat. No. 5,863,283 teaches waste storage application in which nuclear waste filled liners are hung in the wellbores.

The above described methods are all illustrative of prior art methods of nuclear waste disposal. While these methods may be suitable for the particular purpose to which they address, they would not be as suitable for the purposes of the present invention as heretofore described.

SUMMARY OF THE INVENTION

The present invention is concerned with disposing of nuclear waste and, more specifically, to a method of disposing of nuclear waste in underground rock formations using multilateral horizontal boreholes.

A primary object of the present invention is to provide a method of disposing of nuclear waste in underground rock formations.

Another object of the present invention is to provide a method of disposing of nuclear waste in underground rock formations which will provide prolonged safety from the nuclear waste and added protection to human health and the environment.

An additional object of the present invention is to provide a method of disposing of nuclear waste in underground rock formations which will provide protection in case of rupturing or leaking of the canister in which the waste is stored.

Another object of the present invention is to provide a method of disposing of nuclear waste in underground rock formations which will provide safe storage of the waste for at least 10,000 years.

A further object of the present invention is to provide a method of disposing of nuclear waste in underground rock formations which is impervious to surface effects such as flooding, glaciation or seismic interference.

A still further object of the present invention is to provide a method of disposing of nuclear waste in underground rock formations which will bury the waste in horizontally extending boreholes positioned well below the earth's surface.

An even further object of the present invention is to provide a method of disposing of nuclear waste in underground rock formations which will drill a primary vertical wellbore and secondary horizontal laterals extending therefrom.

A yet further object of the present invention is to provide a method of disposing of nuclear waste in underground rock formations wherein the secondary laterals will include an inner lining made from layers of steel and optionally a lead lining.

A still further object of the present invention is to provide a method of disposing of nuclear waste in underground rock formations wherein front and end plugs will be placed within the secondary laterals for retaining canisters filled with waste.

An additional object of the present invention is to provide a method of retrieving back the disposed nuclear waste stored in the horizontal laterals in underground rock formations.

A method of disposing nuclear waste in underground rock formations is disclosed by the present invention. The method includes the steps of selecting an area of land having a rock formation positioned therebelow. The rock formation must be of a depth able to prevent radioactive material placed therein from reaching the surface and must be at least a predetermined distance from active water sources and drilling a vertical wellbore from the surface of the selected area which extends into the underground rock formation. A primary horizontal lateral is drilled from the vertical wellbore whereby the surface of the horizontal lateral is defined by the underground rock formation. A steel casing is placed within the horizontal lateral and cemented in place by circulating cement in the annular space between the steel casing and the wall of the wellbore. Nuclear waste to be stored within the lateral is placed in a canister and the encapsulated nuclear waste is positioned within the primary horizontal lateral. The primary horizontal lateral is then filled with cementitious material to seal the encapsulated nuclear waste therein. Additional primary horizontal laterals can be drilled from the vertical wellbore and secondary and tertiary horizontal laterals can be drilled from the primary horizontal lateral. Additional layers of lead, cement and steel may be used to cover the laterals and shield the rock formation from any radiation leakage. Furthermore, front and end plugs may be positioned at either end of the laterals, retaining the canisters therein and providing added protection from leakage of any solid, liquid or gaseous material.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

Figure 1:
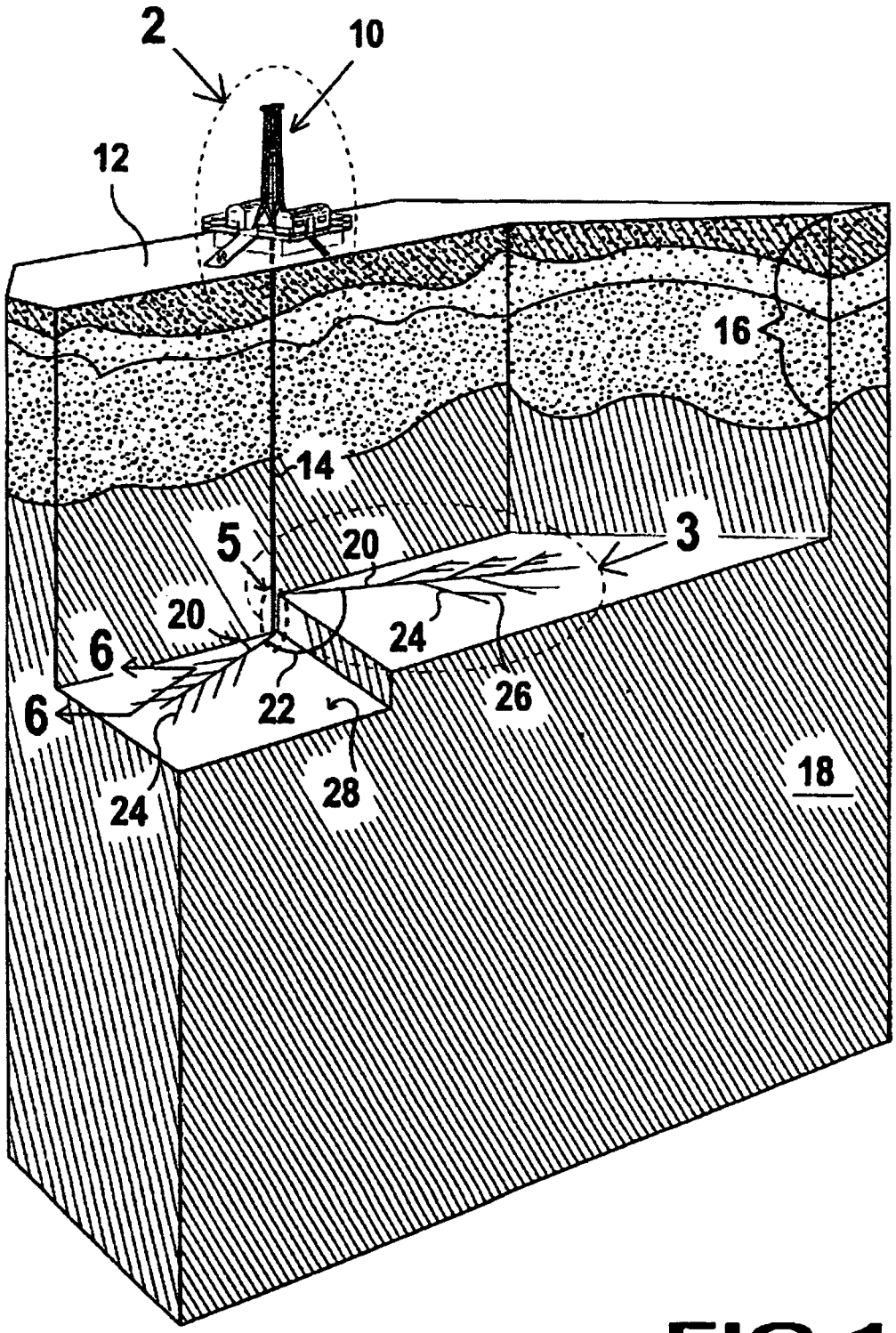
FIG. 1 shows a perspective cross-sectional view of a section of earth on which the method of disposing of nuclear waste in underground rock formations of the present invention is practiced.

| Description of Elements | Reference numerals |
|---|---|
| Drilling rig | 10 |
| Earth's surface | 12 |
| vertical wellbore | 14 |
| surface layers | 16 |
| cap rock layer | 18 |
| primary lateral | 20 |

-continued

| Description of Elements | Reference numerals |
|---|---|
| angle between primary laterals | 22 |
| secondary laterals | 24 |
| tertiary laterals | 26 |
| horizontal plane | 28 |
| protective zone | 29 |
| first layer of cement | 30 |
| first steel casing | 32 |
| second layer of cement | 34 |
| lead liner | 36 |
| canister | 38 |
| centralizers | 40 |
| far end of lateral | 42 |
| front end of lateral | 44 |
| windows | 46 |
| cement filler | 48 |
| front plug | 49 |
| end plug | 50 |
| layer of lead | 52 |
| second steel casing | 54 |
| liner support | 56 |
| sandwiched layer of lead | 58 |
| first layer of steel | 60 |
| second layer of steel | 62 |
| third layer of steel | 64 |
| connector | 73 |
| retrieving tool | 74 |
| drill pipe | 76 |
| sealing material | 75 |
| plugging device | 77 |

DESCRIPTION OF THE EMBODIMENTS

The present invention can be more fully understood by reading the following detailed description of some of the embodiments, with reference made to the accompanying drawings.

FIG. 1 shows a preferred embodiment of the equipment used and the results obtained when practicing the method of the present invention. A drilling rig 10 is positioned on an isolated surface 12 of the earth and is used to create a vertical wellbore 14 which will extend vertically into the earth's surface. The vertical distance is contemplated to be in the range of 5,000 feet to 25,000 feet. The vertical wellbore 14 extends through a plurality of layers of the earth's surface 16 and into a layer of rock 18 herein called the repository. The repository layer of rock 18 is a specially selected rock formation deep enough below the earth's surface to prevent radiation which may leak from reaching the surface. The selected rock formations have existed for billions of years as is evidenced by the chronological fossil history found in the rock strata.

Branching off and extending horizontally from the vertical wellbore 14 at a depth below the earth's surface occupied by the layer of cap rock 18 are primary laterals 20. The primary laterals 20 may be at different depths or at the same depth and extending at an angle 22 from one another. Any number of primary laterals 20 may be drilled from the vertical wellbore, two primary laterals are shown in FIG. 1 for purposes of example only. In one embodiment of the invention there are extending from the primary laterals 20 and along the same horizontal plane 28 are secondary laterals 24 and extending from the secondary laterals 24 and also along the same horizontal plane 28 are tertiary laterals 26. The primary, secondary and tertiary laterals 20, 24, and 26 respectively of a single branch extending from the vertical wellbore 14 all extend in the same horizontal plane 28 while each branch may extend in different horizontal planes as shown in FIG. 1. The formation of cap rock 18 should enclose the primary, secondary and tertiary laterals 20, 24 and 26 on all surfaces to thereby define the dimensions of the laterals and ensure isolation for an indefinite period.

Figure 2:
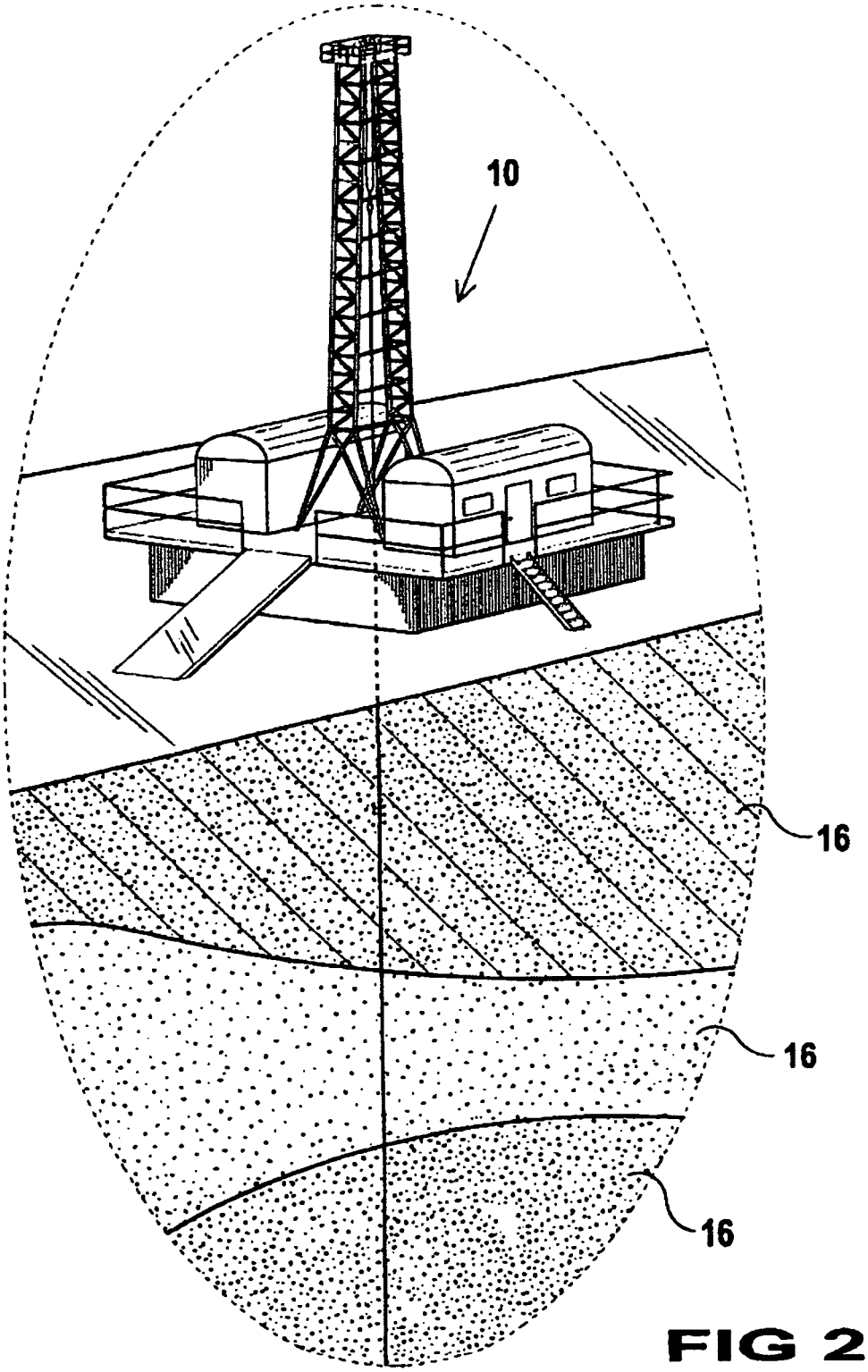
FIG. 2 depicts a perspective view of drilling equipment used to perform the method of disposing of nuclear waste in underground rock formations of the present invention.

FIG. 2 shows a drilling rig 10 which is well known in art and is similar to those used in oil drilling and exploration to reach oil deposits located deep beneath the earth's surface. While a preferred structure for the drilling rig 10 is shown and described herein, those of ordinary skill in the art who have read this description will appreciate that there are numerous other structures for the drilling rig 10 and, therefore, should be construed as including all such structures as long as they achieve the desired result of creating a primary wellbore extending a predetermined distance below a surface of the earth, and therefore, that all such alternative mechanisms are to be considered as equivalent to the one described herein.

Figure 3:
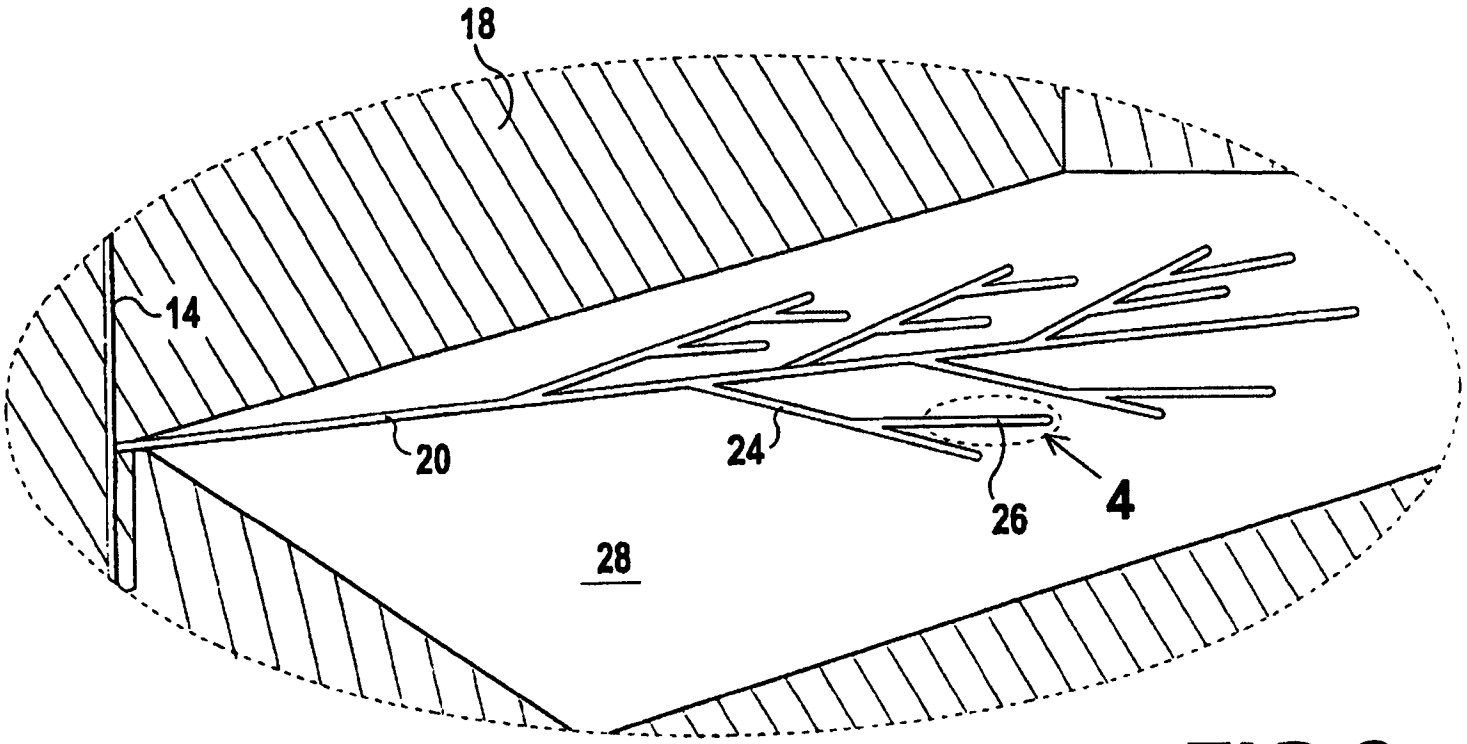
FIG. 3 illustrates a perspective view of horizontal borehole s drilled in accordance with the method of disposing of nuclear waste in underground rock formations of the present invention within the ellipse labeled 3 in FIG. 1.

FIG. 3 illustrates a single branch extending from the vertical wellbore 14. Extending vertically through the repository rock 18 is the vertical wellbore 14. A primary lateral 20 branches out horizontally from the vertical wellbore 14 along the horizontal plane 28 and a plurality of secondary laterals 24 extend from the primary lateral 20 in the horizontal plane 28. A plurality of tertiary laterals 26 extends from the secondary laterals 24 and in the horizontal plane 28. Any number of secondary laterals 24 can extend from each primary lateral 20 and any number of tertiary laterals 26 can extend from each secondary lateral 24. The number of secondary and tertiary laterals 24, 26 are for purposes of description only and not meant to be limiting. The only requirement on the positioning of the secondary and tertiary laterals 24 and 26 is that they cannot overlap one another. Overlapping of the laterals causes communication there-between and will act to reduce the effectiveness of the structure. The lateral wellbores 20, 24, 26 in the embodiments are contemplated to be in the range of 500 feet to 40,000 feet. A distance easily implemented with current drilling technologies. The lateral wellbores will range in size from 4 inch diameter to 20 inch diameter.

Figure 4:
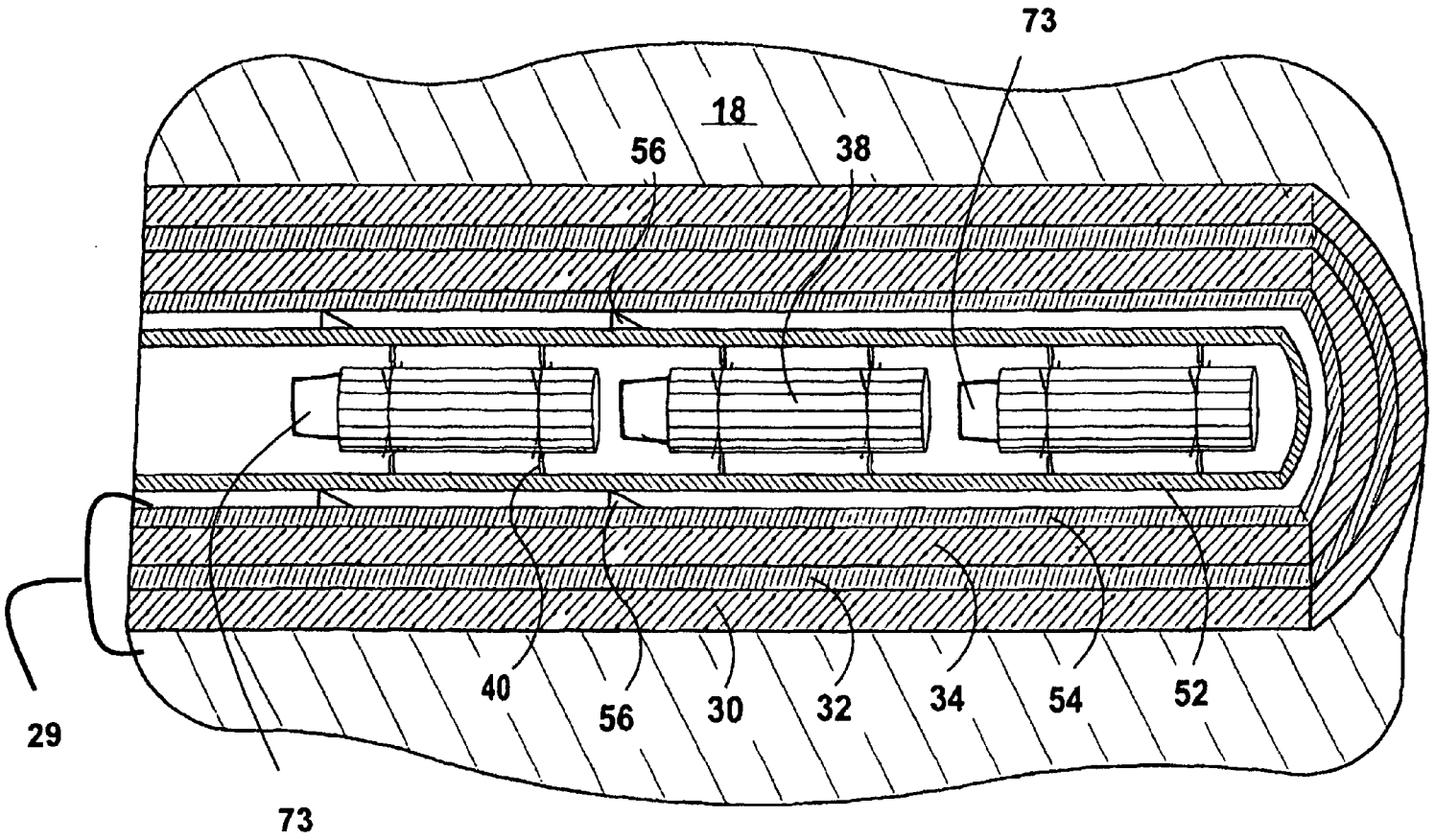
FIG. 4 is a partial cross-sectional view of a section of earth containing canisters storing nuclear waste in accordance with the method of disposing of nuclear waste in underground rock formations of the present invention within the ellipse labeled 4 in FIG. 3.

FIG. 4 illustrates a preferred construction of the tertiary lateral 26 within the circle labeled 4 of FIG. 3 in greater detail, the construction of the primary and secondary laterals 20, 24 respectively, are identical thereto. The tertiary lateral 26 is comprised of a protective zone 29 therein to prevent the leakage of the nuclear waste from the tertiary lateral 26. As illustrated in FIG. 4 the protective zone 29 comprises a first layer of cement 30 within the lateral 26 which forms the first outer layer. A second outer layer is of a steel casing 32 and is sealed within the first outer casing of cement 30. The first layer of cement is thus formed by circulating cement between the first steel casing 32 and the walls of tertiary lateral 26. Further, a second layer of cement 34 and a layer of lead 36 is provided within the steel casing of the tertiary lateral 26.

Nuclear waste is placed and secured within a radioactive capsule or canister 38. The radioactive canister 38 is well known in the art and presently used for securing nuclear waste. Any known method for securing nuclear waste in a container or capsule for placement in a lateral as produced by the present method may be used. The nuclear waste includes the potentially hazardous to the environment waste including nuclear, chemical, warfare waste, biomedical waste.

In the present embodiment, the nuclear waste canisters 38 are mechanically modified with a connector 73 as shown in FIG. 4. The canister connector 73 has a disengagable mechanism that allows the canisters to be taken hold of and lifted or pulled back to the surface. This process is well known in the oil and gas industry and is customarily referred to as "fishing" and it is a well-defined discipline in oil-field well service work. The connector 73 provides a means for attaching the canisters 38 to a retrieving tool 74 and helps in retrieving the canisters 38 when needed. A disengagable connector 73 is defined as an adapter than can be engaged or connected and subsequently disengaged or disconnected.

The canister 38 is positioned in the laterals 20, 24, 26 and may be held in a fixed position within the laterals 20, 24, 26 by a plurality of centralizers 40. The sequence of layers coating the laterals 20, 24, 26 act to protect the rock formation 18 in which the laterals 20, 24, 26 extend from leakage of any nuclear waste. By storing the heavy nuclear waste in horizontal laterals 20,24,26 the weight and pressure exerted in the wellbores by the dense waste is very small compared to the weight and pressures developed in a long vertical well where thousands of feet of waste is stored vertically. The total weight component is based on a few inches, the diameter of the lateral, whereas in the prior art using vertical nuclear storage, the pressures are based on several thousand feet of dense material.

Figure 5:
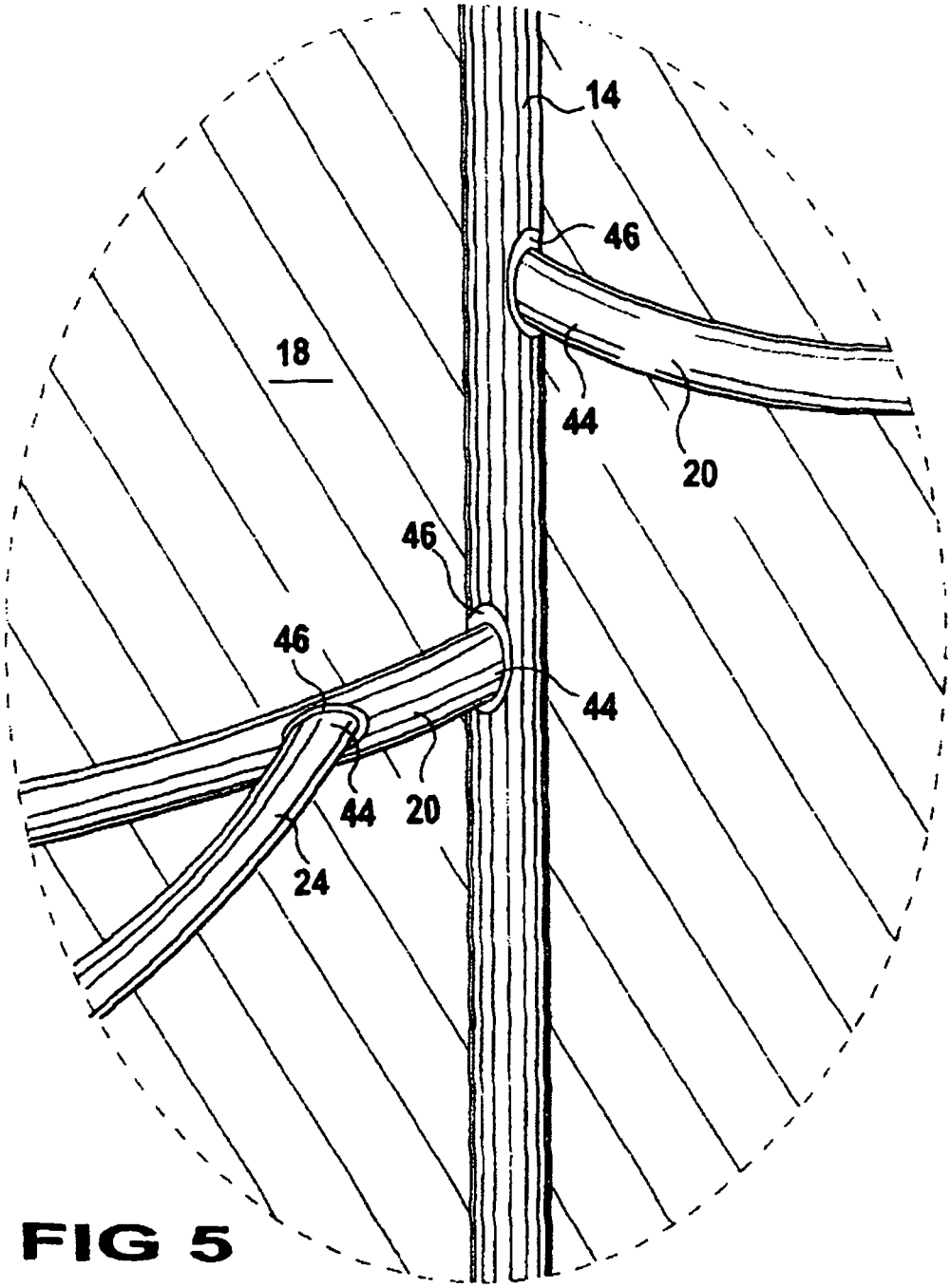
FIG. 5 shows a perspective view of the laterals within the ellipse labeled 5 in FIG. 1.

FIG. 5 illustrates a partial view of a nuclear waste storage network including a wellbore 14 and primary and secondary laterals 20, 24, respectively, extending therefrom. In order to produce a primary lateral 20, a window 46 must be cut into the vertical wellbore 14 at the point from which the primary lateral 20 is to extend. The window cutting process is well known in the drilling industry. The primary lateral 20 is then drilled through the window 46 and extending horizontally into the rock formation 18. The same is true for producing the secondary and tertiary laterals 24, 26. A window 46 must be cut into the lateral at the point from which the dependent lateral will extend. The dependent lateral will then be drilled through the window 46 and into the rock formation 18 in the identical plane in which the primary lateral lies.

Figure 6:
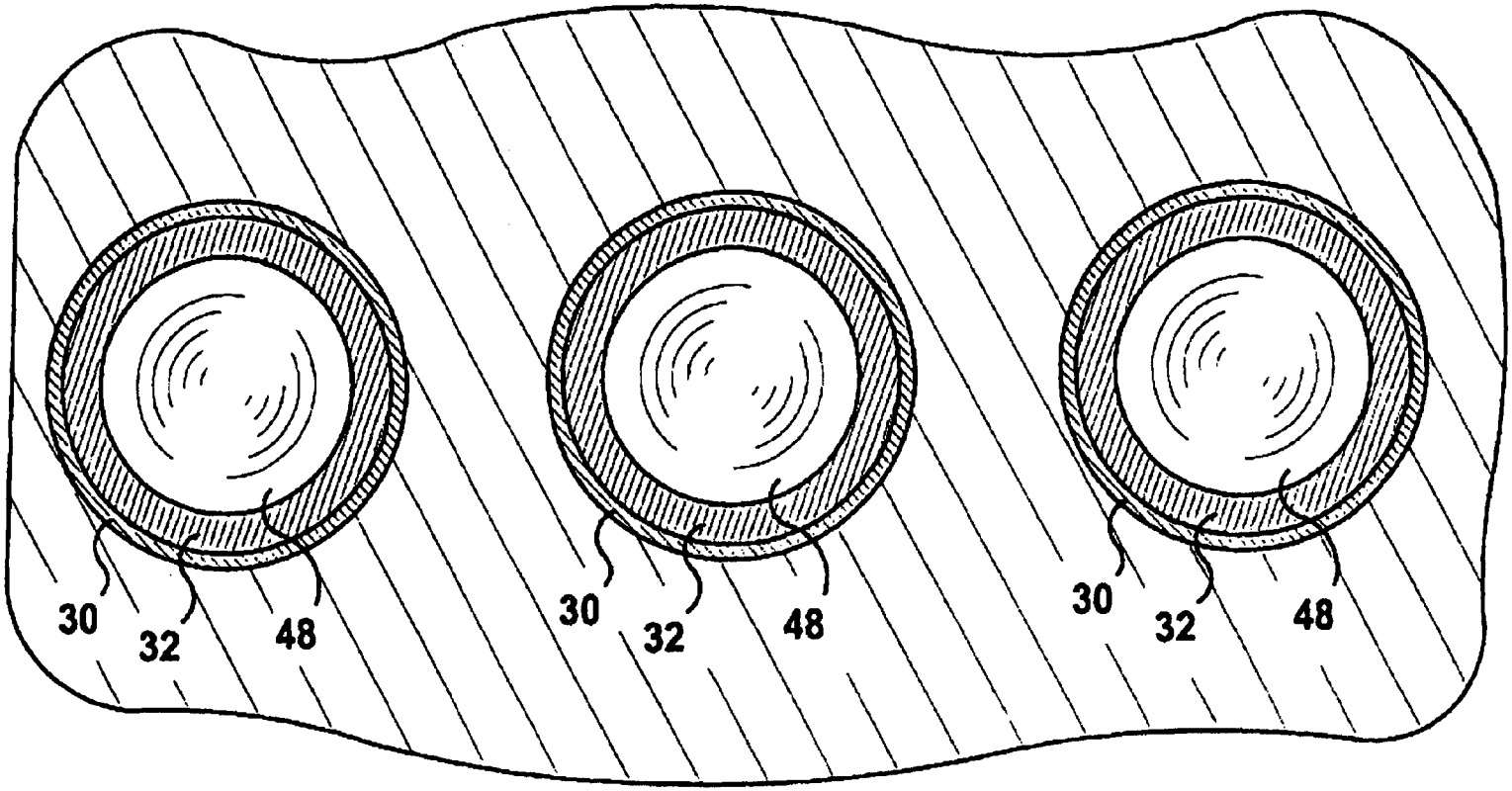
FIG. 6 shows a cross-sectional view taken along the line 6-6 of FIG. 1.

FIG. 6 depicts the cross sectional view of the three secondary laterals along the line 6-6 of the FIG. 1. The figure shows a typical location in the lateral upstream of the location of the stored canisters 38 where cement material 48 fills the wellbore and is surrounded by the steel casing 32 and the first layer of cement 30.

Figure 7:
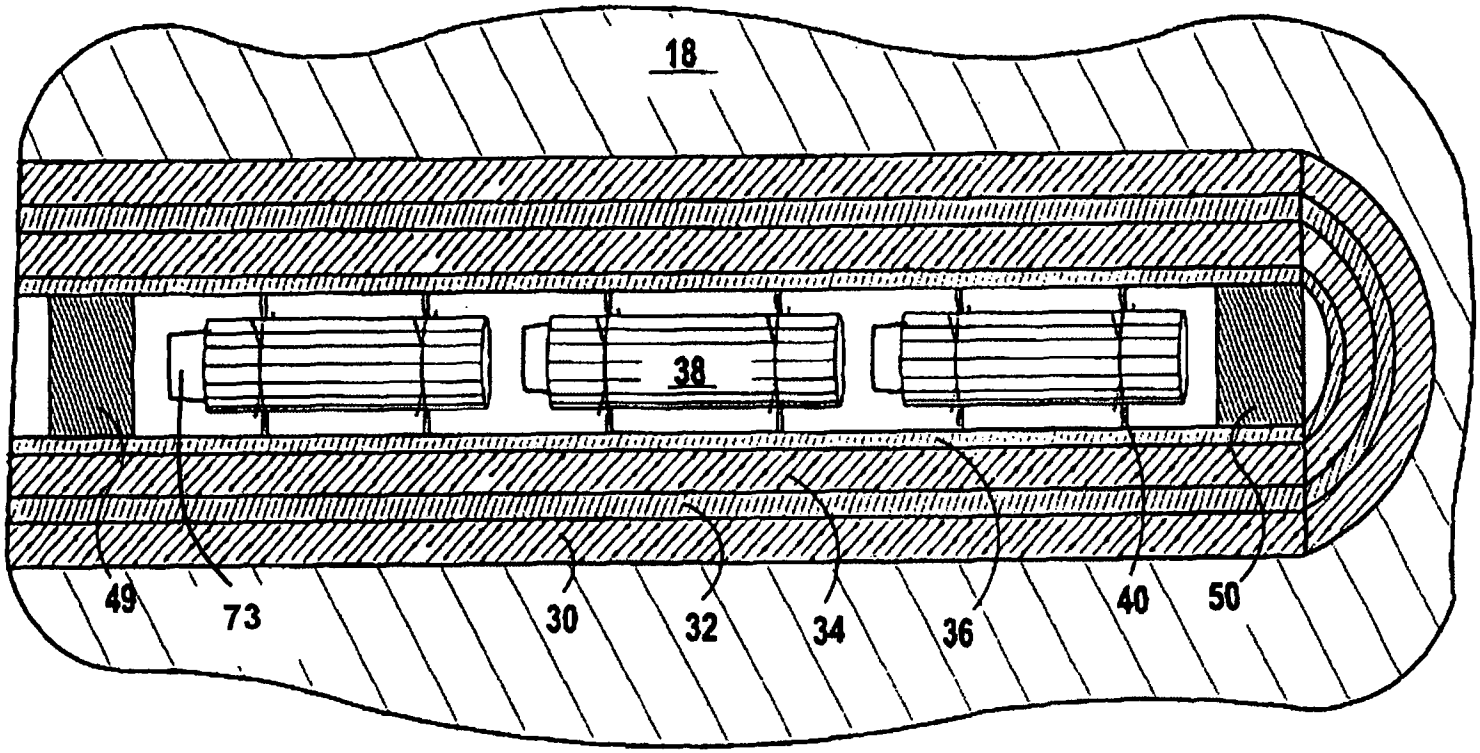
FIG. 7 depicts a cross-sectional view of a lateral used to store the canisters including front and end plugs.

In order to provide additional protection from leaking nuclear waste, a front plug 49 and an end plug 50 may be positioned within the lateral as is illustrated in FIG. 7. The front plug 49 is positioned adjacent the window 46 at the point at which the lateral 20, 24, 26 branches and the end plug 50 is positioned at an end 42 of the lateral 20, 24, 26 opposite the front plug 49. The end plug 50 is inserted into the lateral 20, 24, 26 prior to placement of the canisters 38 and the entry into and exit from the lateral of any liquid, solid or gaseous material thereby providing additional safety from leakage of nuclear waste into the host rock formation 18. These plugs 49, 50 are known and preferably similar to oil field "packers" used to cover the vertical wellbores and prevent oil from exiting the well. However, these plugs 49, 50 may be in any other form which achieves the necessary purpose of providing additional protection from leakage of nuclear waste from the lateral 20, 24, 26.

Figure 8:
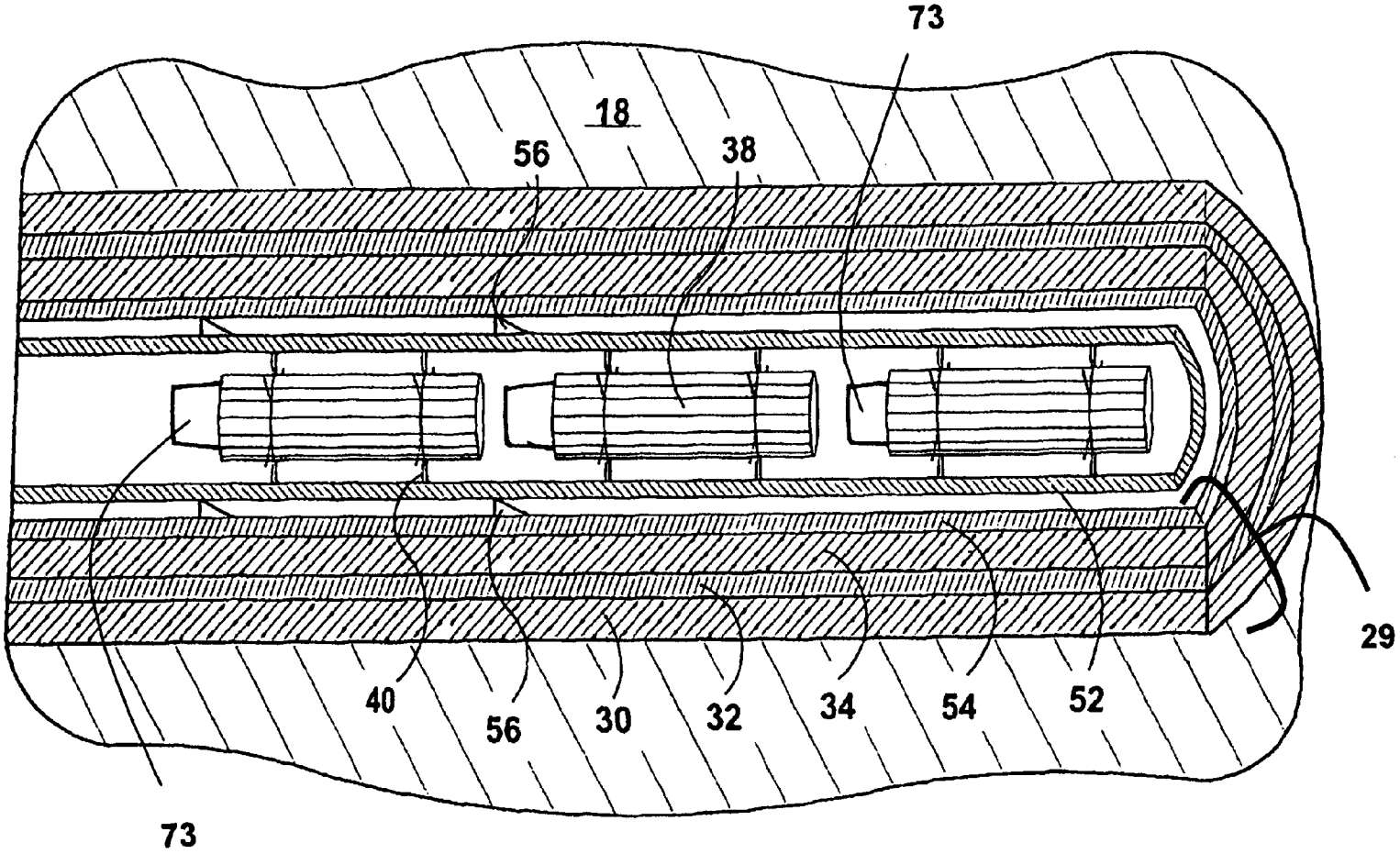
FIG. 8 depicts a partial cross-sectional view of a second embodiment of the sealing layers within a lateral used to store the canisters.

Other embodiments for the protective zone of the laterals are also possible. One such embodiment is illustrated in FIG. 8 wherein a first steel casing 32 is then deployed within the lateral. A first layer of cement 30 is circulated around the steel casing 32 of the laterals 20, 24 or 26. Further a second steel casing 54 is deployed within the first steel casing 32 and a second layer of cement 34 is circulated between the second steel casing 54 and the first steel casing 32. Further, a layer of lead 52 is placed within the second steel casing 54, said layer of lead 52 acting as a liner is separated from the second steel casing 54 by a plurality of liner supports 56 placed between the second steel casing 54 and the layer of lead 52. This lead liner acts as a radiation shield. The liner supports 56 extend only to the entry point of the lateral 20, 24, 26 i.e. the position at which the window 46 is cut.

Figure 9:
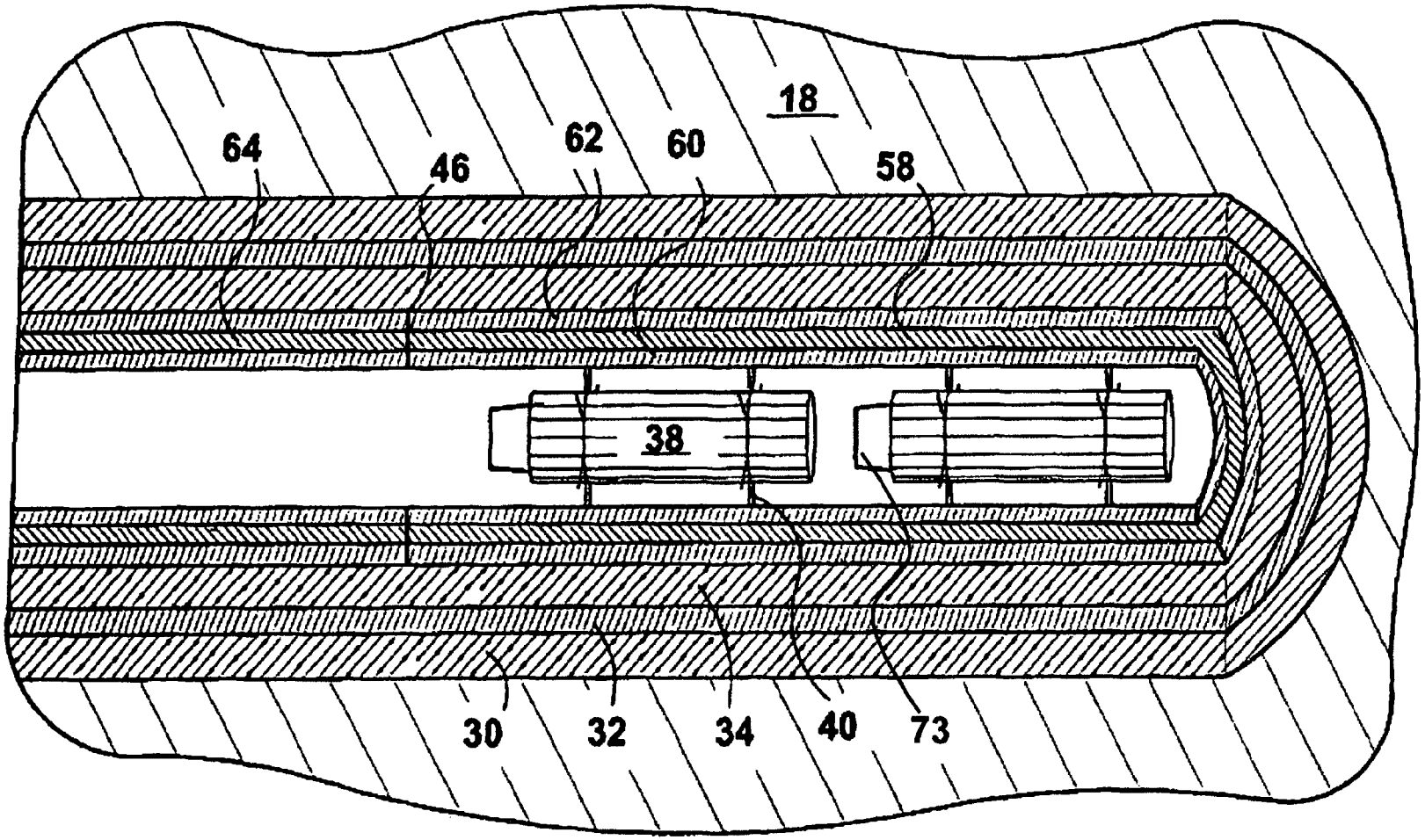
FIG. 9 shows a partial cross-sectional view of a third embodiment of the sealing layers within a lateral used to store the canisters.

FIG. 9 illustrates another embodiment of the protective zone wherein the second steel casing 54 is replaced with a three tired structure. The three tiered structure includes a layer of lead 58 sandwiched between layers of steel 60, 62. As in the embodiment illustrated in FIG. 9, the lead layer 58 only extends to the entry point of the lateral 20, 24, 26. A third layer of steel 64 extends between the sandwiching layers of steel 60, 62 from the entry point of the lateral 20, 24, 26 to the top of the vertical wellbore 14. These additional layers 58, 60, 62 and 64 also provide added protection from radiation which may leak from the canisters, preventing the radiation from leaving the lateral 20, 24, 26 and entering the host rock formation 18.

Figure 10:
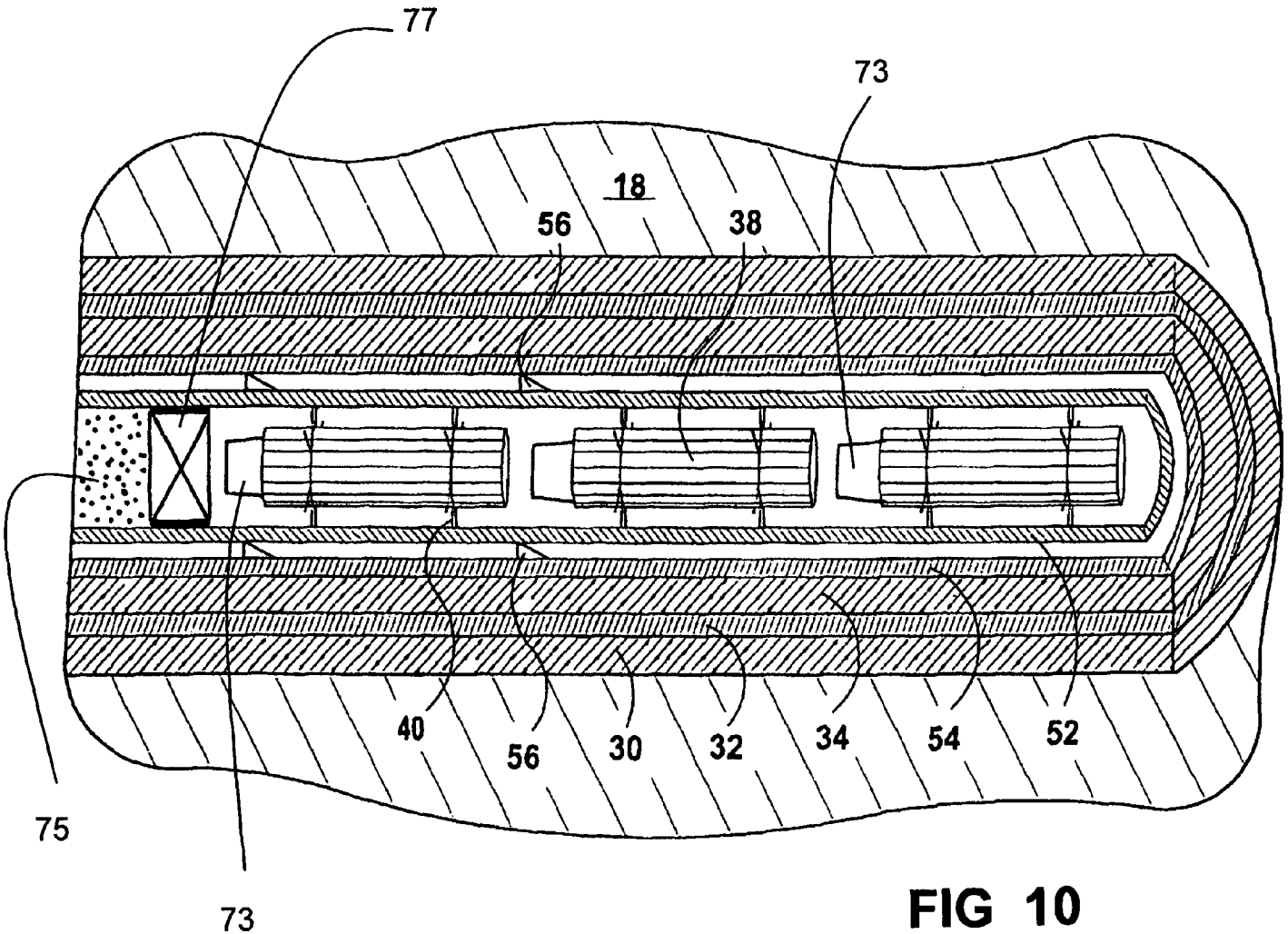
FIG. 10 shows a partial cross-sectional view of the lateral including plugging device and sealing material for sealing the lateral

FIG. 10 shows an embodiment wherein the canisters 38 are positioned within the lateral and a plugging device 77 is installed. This is generally called a bridge plug in the industry and this type of plug is utilized as the primary mechanism in plugging the millions of depleted oil and gas wells around the world. These plugs can vary in properties, and in their emplacement methods but in general they form a permanent mechanical seal in the wellbore such that material below the plug does not migrate above the plug. Therefore, the plugging device 77 is installed in the lateral containing canisters in order to keep the canisters at its own place and prevent movement of the canisters. Further, a plurality of plugging device 77 can be used for multiple safety barriers in sequence. The lateral 20, 24, 26 above the plugging device 77 is now filled with a sealing material 75. There are many other types of sealing material available in market for protection of the nuclear waste canisters 38. However, in the present embodiment the sealing material 75 is a special blend of cement designed to provide leak protection, safety and durability.

A detachable or disengagable connector 73 is connected to the canisters 38. For placing the canister 38 in the lateral 20, 24, 26, the canister 38 is attached to the drill pipe 76 and inserted in to the lateral 20, 24, 26 from the surface of earth. Once deployed within the lateral, the drill pipe 76 is detached from the connector 73 of the canister 38 and is pulled back to the surface, thus depositing the canister 38 with the connector 73 within the lateral 20, 24, 26. The drill pipe 76 may then be used to place additional canisters 38 within the laterals until either the laterals are filled or all the canisters are stored. Further the plugging device 77 and the sealing material 75 is placed within the lateral 20, 24, 26 to avoid movement of nuclear waste from the lateral in case of an inadvertent leakage of the nuclear waste from the canister 38.

Figure 11:
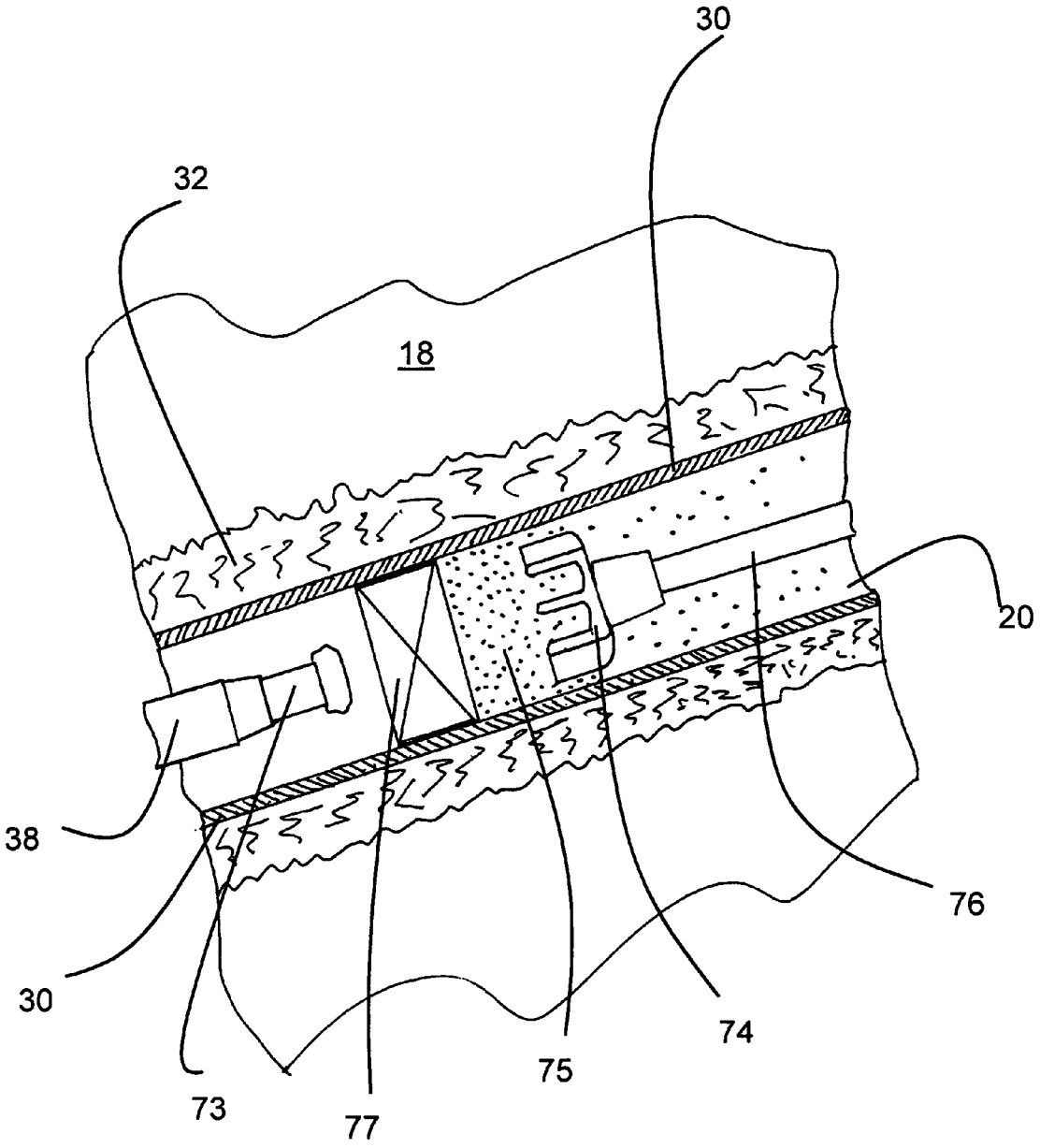
FIG. 11 illustrates the removal of the canister containing nuclear waste through sealing material and plugging device from the lateral.
Figure 12:
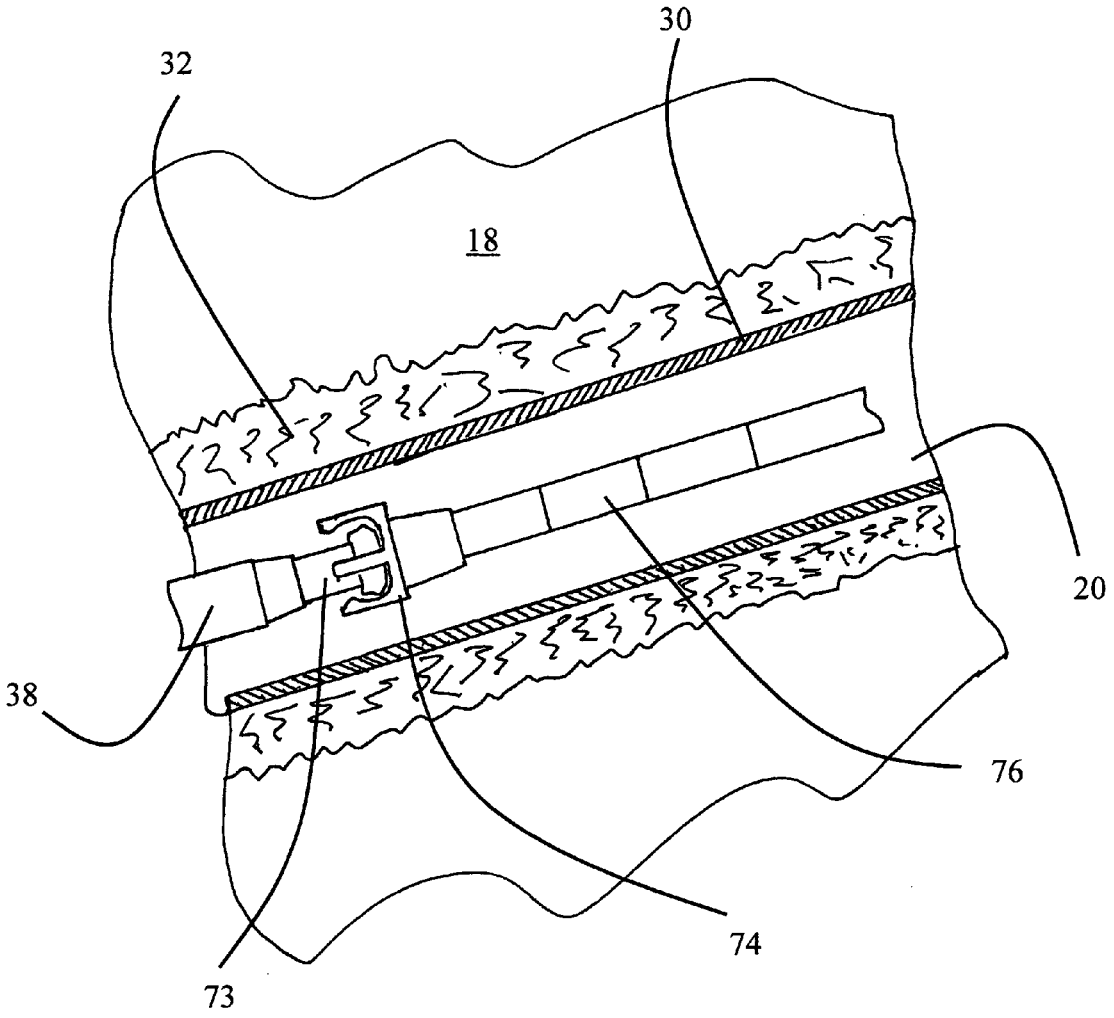
FIG. 12 illustrates the removal of the canister from the lateral.

FIG. 11 illustrates the components necessary for retrieving the canister 38 back to the surface from the laterals 20, 24, 26. As shown in the FIG. the retrieving tool 74 comprises a special drilling bit for drilling the sealing material 75 and a fishing tool for connecting to the connector 73 of the canister 38. For retrieving the canister 38 back to the surface the retrieving tool 74 is inserted in the lateral 20, 24, 26 by the drill pipe 76. The sealing material 75 is drilled out as shown in the FIG. with a special drill bit supported by the pipe 76 which allows the sealing material to be removed without damaging the canister 38. Once the sealing material is removed, the plugging device 77 is also removed and the fishing tool of the retrieving tool 74 is attached to the connector 73 of the canister 38. The fishing tool fishes the canister 38 back to the surface of the earth by drill pipe 76. The engagement of the fishing tool of the retrieving tool with the connector of the canister 38 is illustrated in FIG. 12.

In operation, an isolated area is selected for placement of the wellbore 14 and laterals 20, 24 and 26. The area must include a rock formation 18 therebelow and at a depth great enough to prevent any nuclear waste which may leak from reaching the surface. The rock formation 18 must also be a predetermined safe distance from any underground active water sources.

Upon selection of an appropriate area, a drilling rig 10 such as is used to drill oil wells is used to create a vertical wellbore 14 which extends into the selected rock formation 18. A window 46 is then cut into the vertical wellbore 14 at a depth occupied by the rock formation 18 and at each position from which a primary lateral 20 is desired to extend. A primary lateral 20 is then drilled into the rock formation 18 extending from each window 46 to form each primary lateral 20. The primary laterals 20 may be at differing depths below the surface from one another as long as they extend more or less horizontally, i.e. perpendicular to the vertical wellbore 14, and have dimensions, i.e. sides, defined by the rock formations 18.

Windows 46 are then cut into each primary lateral 20 at each position from which a secondary lateral 24 is desired to extend. The secondary laterals 24 are each then drilled to extend from their respective window 46 and each extend horizontally through the rock formation 18 in the same plane as the primary lateral 20 from which they depend.

Windows 46 are then cut into each secondary lateral 20 at each position from which a tertiary lateral 24 is desired to extend. The tertiary laterals 24 are each then drilled to extend from their respective window 46 and each extend horizontally through the rock formation 18 in the same plane as the primary and secondary laterals 20, 24 from which they depend.

A first steel casing 32 is installed in each lateral 20, 24, 26 and is cemented in place by circulating the cement to form the cement layer 30 which forms the first outer layer. A second outer layer is of a steel casing 54 and is sealed within the first outer casing of cement 30. The first layer of cement is thus formed by circulating cement between the first steel casing 32 and the walls of tertiary lateral 20, 24, 26. Further, a second layer of cement 34 and a layer of lead 36 is provided within the steel casing of the tertiary lateral 20, 24, 26. In order to provide added protection from radiation, which may leak within the laterals 20, 24, 26, the second inner layer of lead may be replaced by alternate constructions.

In an alternate embodiment of the present invention, a first steel casing 32 is installed in the laterals 20, 24, 26. Then a first layer of cement 30 is circulated in the laterals 20, 24 or 26. Further a second steel casing 54 is placed within the first steel casing 32 and a second layer of cement 34 is formed by circulating cement between the second steel casing 54 and the first steel casing 32. Further, a layer of lead 52 is placed within the second steel casing 54, said layer of lead 52 is separated from the second steel casing 54 by a plurality of liner supports 56 placed between the second steel casing 54 and the layer of lead 52. This liner material acts as a radiation shield. The liner support 56 extends only to the entry point of the lateral 20, 24 or 26, i.e. the position at which the window 46 is cut.

A second alternate construction for the second inner layer 36 is also formed of a three-tiered structure. In this construction, a first layer of steel 60 is positioned within the first inner layer of cement 34. A layer of lead 58 is then positioned within the first inner layer of steel 60 and a second layer of steel 62 is positioned within the layer of lead 58 acting to sandwich the layer of lead 58 between the first and second layers of steel 60, 62. In an alternate construction, the layer of lead 58 only extends to the entry point of the lateral. The first and second layers of steel 60, 62 are positioned to cover the entire surface of the lateral in which they are placed and extend through each lateral from which it depends and the vertical wellbore 14. A third layer of steel 64 is positioned between the first and second layers of steel 60, 62 and extends between the sandwiching layers of steel 60, 62 from the entry point of the lateral to the top of the vertical wellbore 14. Portions of the third steel layer 64 may be replaced by a layer of lead 58 within the depending laterals which will house canisters 38 containing nuclear waste. These additional layers 58, 60, 62 and 64 provide added protection from radiation, which may leak from the canisters, preventing the radiation from leaving the lateral and entering the host rock formation 18.

An end plug may then be inserted into each of the lateral 20, 24 or 26 in which it is desired to store canisters 38 containing nuclear waste. The laterals are now prepared for storing the canisters containing nuclear waste. A plurality of centralizers 40 may be connected to the canisters 38 to hold the canisters 38 stationary within the lateral in which they are stored.

The canister 38 is modified with a detachable connector 73. The connector 73 is attached to the drill pipe 76 and is then directed through the vertical wellbore 14 and through the network of laterals until it reaches its final destination for storage. The connector 73 is then separated from the drill pipe 76 and is removed from the network through the laterals and the vertical wellbore 14 and up to the surface 12 of the selected area by hoisting up the tubular string 72. The tubular string 72 is then used to position another canister 38 within the network of laterals 20, 24 or 26. This process is repeated until the network is full or all the canisters 38 are positioned within the network.

The plugging device 77 may then be positioned at the entry point of the lateral 20, 24 or 26, i.e. at the point at which the windows 46 are cut, to seal each lateral and prevent any solid, liquid or gaseous material from escaping from the sealed lateral. The network is further filled with sealing material 75 to seal the canisters 38 in place within their respective lateral 20, 24 or 26 and also act to prevent any nuclear waste which may leak from reaching either the rock formation 18 housing the laterals or the surface of the selected area.

Alternatively, a front plug 49 may be placed within the lateral 20, 24 or 26 and an end plug 50 be placed at the terminating end of the lateral 20, 24 or 26 for sealing the canisters 38 within the lateral 20, 24 or 26 to prevent leakage of the nuclear waste.

From the above description, it is evident that the present invention provides a method of disposing of nuclear waste in underground rock formations and provides prolonged safety from the nuclear waste and added protection to human health and the environment. This method also provides protection in case of rupturing or leaking of the canister in which the waste is stored and safe storage of the waste for at least 10,000 years. It also provides storage of nuclear waste, which is impervious to surface effects such as flooding, glaciation or seismic interference. The laterals in which the waste is stored include an inner lining made from layers of cement, steel and lead and possibly also include front and end plugs to provide the above benefits.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

The invention claimed is:

1. A method of temporarily or permanently disposing of nuclear waste in underground rock formations, comprising the steps of a) electing an area of land having a rock formation positioned therebelow of a depth able to prevent radioactive material placed therein from reaching a surface of the area of land and of a predetermined distance from active water sources;

b) drilling a vertical wellbore extending to a depth between 5,000 feet and 25,000 feet, from the surface of the area of land to extend into the underground rock formation;

c) drilling a first primary lateral extending horizontally from the vertical wellbore whereby the primary lateral is defined by the underground rock formation extending to a distance between 500 feet and 40,000 feet;

d) encapsulating nuclear waste to be stored in a canister for storage in the primary lateral;

e) placing the encapsulated nuclear waste in the primary lateral and f) retrieving the encapsulated nuclear waste from the primary lateral when needed.

2. The method of disposing nuclear waste in underground rock formations of claim 1, further comprising the steps of:

a) drilling a secondary lateral into the rock formation, for a distance in the range from 500 feet to 5,000 feet, from at least one primary lateral, said secondary lateral extending in a horizontal plane with the primary laterals and being defined by the underground rock formation;

b) encapsulating nuclear waste to be stored in a plurality of canisters, each of said plurality of canisters to be stored in one of the secondary laterals;

c) placing each of the plurality of canisters in one of the secondary laterals and d) retrieving the encapsulated nuclear waste from the secondary lateral when needed.

3. The method of disposing nuclear waste in underground rock formations of claim 2, further comprising the steps of:

a) drilling a tertiary lateral for a distance in the range from 500 feet to 5,000 feet, into the rock formation from at least one secondary lateral, the tertiary lateral extending in a horizontal plane with the primary and said secondary laterals and being defined by the underground rock formation;

b) encapsulating nuclear waste to be stored in a plurality of canisters, each of said plurality of canisters to be stored in one of the tertiary laterals;

c) placing each of the plurality of canisters in a respective one of the tertiary laterals;

d) retrieving the encapsulated nuclear waste from the tertiary lateral when needed.

4. The method of disposing nuclear waste in underground rock formations of claim 3, wherein the encapsulated nuclear waste is retrieved from the laterals by the steps of:

a) inserting a retrieving tool attached with a drill pipe from the surface of earth into the lateral;

b) connecting the retrieving tool to a connector of the canister and c) pulling a drill pipe to retrieve the canister on the surface of earth.

5. The method of disposing nuclear waste in underground rock formations of claim 3, further comprising the steps of placing a protective zone within each of the laterals for preventing further leakage of the nuclear waste from the laterals.

6. The method of disposing nuclear waste in underground rock formations of claim 5, wherein placing the protective zone further comprises the steps of:

a) deploying a first steel casing;

b) deploying a first layer of cement by circulating cement between the first steel casing and the wall of the lateral;

c) deploying a second steel casing within the first steel casing;

d) deploying second layer of cement by circulating cement between the second steel casing and the first steel casing and e) deploying a layer of lead within the second steel casing, wherein the layer of lead is separated from the second steel casing by a plurality of liner supports placed between said second steel casing and said layer of lead.

7. The method of disposing nuclear waste in underground rock formations of claim 5, wherein placing the protective zone further comprises the steps of a) deploying a first steel casing;

b) deploying a first layer of cement by circulating cement between the first steel casing and the wall of the lateral;

c) deploying a layer of lead within the first steel casing and d) deploying a second layer of cement formed by circulating cement between the steel casing and the layer of lead.

8. The method of disposing nuclear waste in underground rock formations of claim 5, wherein the protective zone further comprises the steps of:

a) deploying a first steel casing;

b) deploying a first layer of cement by circulating cement between the first steel casing and the wall of the lateral;

c) deploying a three tired layer within the steel casing comprising a layer of lead sandwiched between two layers of steel and d) deploying a second layer of cement formed by circulating cement between the steel casing and the three tired layer.

9. The method of disposing nuclear waste in underground rock formations of claim 5, further comprising the steps of placing a plugging device within each of the laterals wherein the canisters are stored for sealing the respective lateral in order to prevent leakage of the nuclear waste from the canister.

10. The method of disposing nuclear waste in underground rock formations of claim 9, further comprising the steps of placing a sealing material filled above the plugging device within each of the laterals to seal the encapsulated nuclear waste therein.

11. The method of disposing nuclear waste in underground rock formations of claim 5, further comprising the steps of a) placing a front plug within each of the plurality of laterals at a respective terminating end thereof prior to said step of placing the encapsulated nuclear waste in each of the plurality of laterals and b) placing an end plug within each of the plurality of laterals at a respective front end thereof opposite the terminating end after said step of placing the encapsulated nuclear waste in each of the plurality of laterals.

* * * * *